US005298356A

United States Patent [19]

Tyagi et al.

[11] Patent Number: 5,298,356

[45] Date of Patent: Mar. 29, 1994

[54] TONER COMPOSITION WITH ELASTOMERIC THERMOPLASTIC POLYMER AND PROCESS OF PREPARING

[75] Inventors: Dinesh Tyagi, Fairport; Donna A. DiPrima, Rochester, both of N.Y.

[73] Assignee: Eastman Kodak Company, Rochester, N.Y.

[21] Appl. No.: 975,745

[22] Filed: Nov. 13, 1992

[51] Int. Cl.[5] ..... G03G 9/097

[52] U.S. Cl. ..... 430/110; 430/137

[58] Field of Search ..... 430/110, 137

[56] References Cited

U.S. PATENT DOCUMENTS

| | | | |
|---|---|---|---|
| 3,985,830 | 10/1976 | Fetters et al. . | |
| 4,027,048 | 5/1977 | Crystal . | |
| 4,557,991 | 12/1985 | Takagiwa et al. | 430/109 |
| 4,758,506 | 7/1988 | Lok et al. | 430/106.6 X |
| 4,814,253 | 3/1989 | Gruber et al. | 430/106.6 |
| 4,833,060 | 5/1989 | Nair et al. | 430/137 |
| 4,835,084 | 5/1989 | Nair et al. | 430/137 |
| 4,965,131 | 10/1990 | Nair et al. | 428/407 |
| 5,118,588 | 6/1992 | Nair et al. | 430/110 |

FOREIGN PATENT DOCUMENTS

| | | | |
|---|---|---|---|
| 90958 | 7/1980 | Japan | 430/110 |
| 59-147044A | 8/1984 | Japan . | |
| 2075703 | 11/1981 | United Kingdom . | |

*Primary Examiner*—Roland Martin

*Attorney, Agent, or Firm*—Willard G. Montgomery

[57] ABSTRACT

A method is described for the preparation of electrostatographic toner particles which involves the surface treatment of a pigment by depositing thereon a coating of an elastomeric thermoplastic polymer. The method involves preparing a polymer solution by dissolving an elastomeric thermoplastic polymer selected from the group consisting of linear styrene-isoprene-styrene triblock copolymers, linear styrene-ethylene-butylene-styrene triblock copolymers, linear styrene-isoprene diblock copolymers and linear styrene-ethylene-propylene diblock copolymers in a first solvent capable of dissolving the polymer at ambient temperature; forming a pigment dispersion by mixing at ambient temperature a pigment, a first polymer material and a second solvent in which the elastomeric thermoplastic polymer is insoluble at ambient temperature; admixing the polymer solution with the pigment dispersion so resulting in the elastomeric thermoplastic polymer precipitating out upon the surface of the pigment; mixing the elastomeric thermoplastic polymer coated pigment dispersion thus formed with a solvent in which the elastomeric thermoplastic polymer is insoluble at ambient temperature and, optionally, a second polymer material and, optionally, a charge-control agent to form an organic phase; dispersing the organic phase in an aqueous phase comprising a particulate stabilizer and, optionally, a promoter; homogenizing the resultant mixture, and evaporating the solvent and washing and drying the resultant product.

18 Claims, No Drawings

TONER COMPOSITION WITH ELASTOMERIC THERMOPLASTIC POLYMER AND PROCESS OF PREPARING

FIELD OF THE INVENTION

This invention relates to polymeric powders suitable for use as electrostatographic toner and, more particularly, to a method for the preparation of toner particles including a dispersed surface active pigment coated uniformly with an elastomeric thermoplastic polymer.

BACKGROUND OF THE INVENTION

Electrostatic toner polymer particles are commonly prepared by a process frequently referred to as "limited coalescence." In this process, polymer particles having a narrow size distribution are obtained by forming a solution of a polymer in a solvent that is immiscible with water, dispersing the polymer/solvent solution in an aqueous medium containing a solid colloidal stabilizer, and removing the solvent. The resultant particles are then isolated, washed, and dried.

In the practice of this technique, toner particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by the agitation employed.

Limited coalescence techniques of this type have been described in numerous patents pertaining to the preparation of electrostatic toner particles because such techniques typically result in the formation of toner particles having a substantially uniform size and uniform size distribution. Representative limited coalescence processes employed in toner preparation are described in U.S. Pat. Nos. 4,833,060 and 4,965,131.

In the conventional limited coalescence techniques described heretofore, the judicious selection of toner additives such as charge control agents and pigments permits control of the surface roughness of toner particles by taking advantage of the aqueous organic interphase present. However, if any toner additive employed for this purpose is highly surface active or hydrophilic in nature, it tends to be present at the surface of the toner particles. Unfortunately, this leads to numerous potential problems such as toner particles having lower charge/mass ratios, rougher particles, poor thermal transfer, poor electrostatic transfer, reduced pigment coverage, interference with the limited coalescence process, sensitivity to environment, and the like.

Accordingly, workers in the art have recognized that toner additives must either be avoided or kept away from the particle surface. One method for obviating this limitation is to select an additive which is neither surface active or hydrophilic in nature. However, it is often not feasible to find an alternative additive evidencing the properties sought. Thus, it then becomes necessary to modify the surface of the additive.

Efforts to achieve this end have generally focused upon the use of suitable dispersion aids as, for example, polymers with acid or other polar functionality as described in copending application Ser. No. 501,819, filed by M. Nair, Z. Pierce and D. Tyagi. These polymeric stabilizers are used to treat carbon pigment to prevent the hydrophilic carbon from migrating to the surface. Toners prepared in this manner evidence enhanced electrostatic transfer, reduced electrical conductivity, and low D-min or fog.

A similar treatment employed in conjunction with toners of smaller particle size has frequently been found unsuccessful due to an increase in solution viscosity of the organic phase at the concentration of dispersant and pigment level employed. Limited coalescence toners prepared with an organic phase of this type tend to yield particles of broad size distribution and tend to interfere with the limited coalescence process. Furthermore, use of this technique requires the presence of reactive sites on the additive surface of the toner particles to which a dispersant may associate.

Recently, a technique was described in copending application Ser. No. 890,053, filed May 28, 1992, entitled "Electrostatographic Toner Including A Wax Coated Pigment and Method for the Preparation Thereof," for obviating the foregoing limitations wherein a highly surface active pigment was coated with a hydrophobic wax which is insoluble in the solvents commonly employed in toner preparation. Studies revealed that the wax coating prevents the pigment from migrating to the surface of the toner and provides a spherical surface thereto. This results in a narrow distribution of charge from particle to particle and permits image transfer without the occurrence of fog in the background. The wax coating also reduces the likelihood of surface contamination by the pigment due to the fact that is kept away from the surface. Particulate material prepared in accordance with this technique evidences charging characteristics that render the particles suitable for use as electrostatographic toner particles.

The technique described comprises the steps of dissolving a low melting point wax in a solvent at an elevated temperature, admixing the resultant solution with a heated pigment dispersion in colloidal form, and permitting the mixture to cool slowly to ambient conditions, the wax precipitating upon the pigment surface during the cooling process; recovering the wax coated pigment particles from the mixture and mixing therewith a polymer material, a solvent and, optionally, a charge-control agent to form an organic phase; dispersing the organic phase in an aqueous phase comprising a particulate stabilizer and, optionally, a promoter, homogenizing the mixture, evaporating the solvent and washing and drying the resultant product.

Unfortunately, this technique requires the use of elevated temperatures to dissolve the wax in the solvent to form the wax solution prior to admixing the wax solution with the pigment dispersion and to heat the pigment dispersion prior to combining it with the wax solution. This is undesirable because the requirement of having to heat both the wax solution and the pigment dispersion in practicing this technique requires the expenditure of substantial amounts of time and energy which adds to the overall cost of producing the toner compositions by this technique.

SUMMARY OF THE INVENTION

In accordance with the present invention, the prior art limitations are effectively obviated by a novel process which embraces dissolving at ambient temperature an elastomeric thermoplastic polymer in a first solvent capable of dissolving the polymer at ambient temperature to form a polymer solution; forming a pigment dispersion by mixing at ambient temperature a pigment, a first polymer material and a second solvent in which the elastomeric thermoplastic polymer is insoluble at ambient temperature; admixing the polymer solution with the pigment dispersion so resulting in the elastomeric thermoplastic polymer precipitating out upon the pigment surface as a coating thereon and changing its surface activity; mixing the polymer coated pigment dispersion thus formed with a second polymer material, if required as dictated by the concentration of the pigment dispersion, a solvent in which the elastomeric thermoplastic polymer is insoluble at ambient temperature and, optionally, a charge-control agent to form an organic phase; dispersing the organic phase in an aqueous phase comprising a particulate stabilizer and, optionally, a promoter, homogenizing the resultant mixture and then evaporating the solvent and washing and drying the resultant product. Applicants have found that by utilizing polymers of the type employed herein as coating materials for otherwise highly surface active pigments, that such pigments can be rendered non-surface active as in the case of the use of the hydrophobic waxes of the prior art and, moreover, by utilizing two different solvents, i.e., one in which the elastomeric thermoplastic polymer is soluble at ambient temperature to form the polymer solution and another solvent in which the elastomeric thermoplastic polymer is insoluble at ambient temperature to form the pigment dispersion and the organic phase, all heating requirements are eliminated from the prior art process and the cost of producing toners containing otherwise hydrophilic or surface active pigments which have been rendered non-surface active is substantially reduced. In addition, it has also been found that, as is in the case of the hydrophobic waxes of the prior art, that the polymer coatings utilized in the present invention prevent the pigment from migrating to the surface of the toner and provides a spherical surface thereto which also results in a narrow distribution of charge from particle to particle and permits image transfer without the occurrence of fog in the background. The polymer coating also reduces the likelihood of surface contamination by the pigment due to the fact that is kept away from the surface. Particulate material prepared in accordance with this technique evidences charging characteristics that render the particles suitable for use as electrostatographic toner particles.

The elastomeric thermoplastic polymers employed in the practice of the present invention are of a specific type and are selected from the group consisting of linear styrene-isoprene-styrene triblock copolymers, linear styrene-ethylene-butylene-styrene triblock copolymers, linear styrene-isoprene diblock copolymers and linear styrene-ethylene-propylene diblock copolymers. These polymers will be discussed more fully in detail below.

Thus, viewed from one aspect, the present invention is directed to a method for the preparation of electrostatographic toner. The method comprises the steps of dissolving an elastomeric thermoplastic polymer selected from the group consisting of linear styrene-isoprene-styrene triblock copolymers, linear styrene-ethylene-butylene-styrene triblock copolymers, linear styrene-isoprene diblock copolymers and linear styrene-ethylene-propylene diblock copolymers in a first solvent capable of dissolving the elastomeric thermoplastic polymer at ambient temperature to form a polymer solution; forming a pigment dispersion by mixing at ambient temperature a pigment, a first polymer material and a second solvent in which the elastomeric thermoplastic polymer is insoluble at ambient temperature; admixing the polymer solution with the pigment dispersion so resulting in the elastomeric thermoplastic polymer precipitating out upon the pigment surface; mixing the polymer coated pigment dispersion thus formed with a solvent in which the elastomeric thermoplastic polymer is insoluble at ambient temperature and, optionally, a second polymer material and, optionally, a charge-control agent to form an organic phase; dispersing the organic phase in an aqueous phase comprising a particulate stabilizer and, optionally, a promoter; and homogenizing the resultant mixture; evaporating the solvent and washing and drying the resultant product.

Viewed from another aspect, the present invention is directed to a process for preparing electrostatographic toner by dispersing an organic phase in an aqueous phase to yield a layer of particulate suspension stabilizer on the surface of the polymer. The improvement in the process comprises dissolving an elastomeric thermoplastic polymer selected from the group consisting of linear styrene-isoprene-styrene triblock copolymers, linear styrene-ethylene-butylene-styrene triblock copolymers, linear styrene-isoprene diblock copolymers and linear styrene-ethylene-propylene diblock copolymers in a first solvent capable of dissolving the elastomeric thermoplastic polymer at ambient temperature; forming a pigment dispersion by mixing at ambient temperature a pigment, a first polymer material and a second solvent in which the elastomeric thermoplastic polymer is insoluble at ambient temperature; admixing the polymer solution with the pigment dispersion so resulting in the elastomeric thermoplastic polymer precipitating out upon the pigment surface; mixing the polymer coated pigment dispersion thus formed with a solvent in which the elastomeric thermoplastic polymer is insoluble at ambient temperature and, optionally, a second polymer material and, optionally, a charge-control agent to form an organic phase in the aforementioned limited coalescence process.

These and other features and advantages of the present invention will be better understood taken in conjunction with the following detailed description and claims.

DETAILED DESCRIPTION OF THE INVENTION

In accordance with the present invention, an elastomeric thermoplastic polymer selected from the group consisting of linear styrene-isoprene-styrene triblock copolymers, linear styrene-ethylene-butylene-styrene triblock copolymers, linear styrene-isoprene diblock copolymers and linear styrene-ethylene-propylene diblock copolymers is dissolved in a solvent capable of dissolving the polymer at ambient temperature. Next, a pigment dispersion is prepared at ambient temperature by conventional techniques as, for example, media milling a first polymer (binder), a pigment and a second solvent in which the elastomeric thermoplastic polymer is insoluble at ambient temperature. In this process, the pigment is broken down into small pieces which mix with the polymer. It has been found advantageous in the practice of the invention to employ from about 4.5 to 18.0 percent, by weight, pigment, from about 0.5 to 2.0 percent, by weight, polymeric binder, the remaining being solvent. The pigment dispersion prepared as described is then admixed with the polymer solution at ambient temperature. In this process, the elastomeric thermoplastic polymer present in solution slowly precipitates upon the surface of the dispersed pigment since the polymer is insoluble in the solvent used to form the pigment dispersion.

Following such preparation, the coated pigment dispersion is mixed with a solvent and, optionally, a second polymer material and, optionally, a charge-control agent to form an organic phase in which the pigment concentration may range from about 1 to 40%, by weight, based upon the total weight of solids. A preferred range has been found to range from 4 to 20%, by weight. The charge-control agent is employed in an amount ranging from 0 to 10 parts per hundred, based on the total weight of solids present, with a preferred range being from 0.2 to 3.0 parts per hundred. The solvent is employed in an amount ranging from about 250 to 900 percent by weight based upon the total weight of the final product (total weight of the solids present) and the second polymer is present in an amount ranging from 0 to 95 percent by weight, based upon the total weight of the final product. It will be appreciated that the solvent chosen for forming the organic phase is also one in which the elastomeric thermoplastic polymer is insoluble at ambient temperature so that polymer coatings formed upon the surface of the pigment particles will not dissolve in the organic phase and, further, that the solvent used to form the pigment dispersion and the organic phase can be the same or different as long as the elastomeric thermoplastic polymer is insoluble therein at ambient temperature.

Following this step, the mixture is permitted to stir overnight and is then dispersed in an aqueous phase comprising a particulate stabilizer and, optionally, a promoter.

The elastomeric thermoplastic polymers which are utilized in the practice of the present process are thermoplastic rubber polymers. They are block copolymers with hard polystyrene segments combined with soft elastomeric segments. The specific polymers used in the practice of the present invention are less surface active than the pigments utilized in the practice of the present invention, are hydrophobic relative to the hydrophilic surface of the media milled surface active pigments utilized herein and include linear styrene-isoprene-styrene triblock copolymers, linear styrene-ethylene-butylene-styrene triblock copolymers, linear styrene-isoprene diblock copolymers and linear styrene-ethylene-propylene diblock copolymers. These polymers are available commercially from Shell Chemical Company (Houston, Tex.) and are designated generally as Kraton 1000 polymers. The linear styrene-isoprene-styrene triblock copolymers and the linear styrene-isoprene diblock copolymers are designated as Kraton D1000 Series products and the linear styrene-ethylene-butylene-styrene triblock copolymers and linear styrene-ethylene-propylene diblock copolymers are designated as Kraton G1600 Series products. The block copolymers form a two-phase system. The polystyrene and elastomeric blocks are thermodynamically incompatible. The polystyrene blocks form hard domains within the elastomer matrix and act as "physical crosslinks" between them. During processing, in the presence of heat and shear or solvent, the polystyrene domains soften and permit flow. After cooling or solvent evaporation, the polystyrene domains reform and harden, locking the rubber network in place again.

The physical crosslinking and reinforcing gives the rubber polymer a high tensile strength while the rubber block gives the thermoplastic rubber polymer its elasticity.

These block structures are produced by anionic polymerization which allows for the formation of pure blocks with no tapering, precise control over the molecular weight and molecular weight distribution. The molecular weight distribution for the polymers, for example, is extremely narrow ($M_w/M_n$=about 1).

Typically, the styrene to rubber ratios for the linear styrene-isoprene-styrene triblock copolymers which are used in the practice of the present invention are 14/86, 22/78, 14/86 and 17/83. Typical styrene to rubber ratios for the linear styrene-ethylene-butylene-styrene triblock copolymers are 29/7, 13/87, 32/68 and 30/70. Typical styrene to rubber ratios for the styrene-ethylene-propylene diblock copolymers are 37/63 and 28/72. A typical styrene to rubber ratio for the linear styrene-isoprene diblock copolymers employed in the present invention is 10/90. In general, the elastomeric thermoplastic polymers which are utilized herein have a number average molecular weight ranging from about 71,000 to about 220,000 and a weight average molecular weight ranging from about 87,000 to about 300,000.

Because of its two-phase structure, the thermoplastic rubber polymers utilized in the practice of the present invention have two glass transition temperatures rather than only one as found in random copolymers. Thus, the glass transition temperature of the polystyrene component or segment of the instant polymers is about 200° F., while the glass transition temperatures of the polyisoprene, the polyethylene/propylene and polyethylene/butylene rubber segments are about −65° F., −50° F. and −55° F., respectively.

The solvents chosen for use in the polymer dissolution step may be selected from any of the well known solvents capable of dissolving the elastomeric thermoplastic rubber polymers of the type employed herein at ambient temperature. In contrast to the usual plastics and rubbers, however, which have only a single phase, the thermoplastic rubber polymers used in the present invention have two phases, as recited above. In order to form a true solution, the solvent system must be capable of dissolving both of these phases. There are many inexpensive hydrocarbon solvents and some non-hydrocarbon solvents, which will dissolve both phases. If blends of solvents are used, an even wider variety of solvent systems may be considered.

A polymer will generally dissolve in those solvents with solubility parameters close to that of the polymer itself. "Solubility parameter" is defined herein as Hildebrand's solubility parameter (represented by $\delta$) which is a measure of the total forces holding the molecules of a solid or a liquid together. It has the units of $(cal/cm^3)^{\frac{1}{2}}$. Every compound is characterized by a specific value of solubility parameter. Materials having the same solubility parameter tend to be miscible. Those with different solubility parameters tend to be mutually insoluble. Discussions of solubility parameter concepts are presented in (1) Encyclopedia of Polymer Science and Technology, Interscience, New York (1965), Volume 3, page 833; and (2) Encyclopedia of Chemical Technology, Interscience, New York (1971), Supplement Volume, page 889. Since the thermoplastic rubber polymers have two different polymers in each molecule, a good solvent must have a solubility parameter suitable for both. In general, the higher the molecular weight of the polymer, the smaller the difference in solubility parameters between the polymer and the solvent must be. Therefore, with a low molecular weight polymer, a wider range of solvents can be used than with a higher molecular weight polymer.

The solubility parameters for the three types of rubber midblocks or networks in the thermoplastic rubber polymers which are used in the practice of the present invention are about 7.9 for polyethylene-polybutylene, 8.1 for poly(isoprene) and 7.9 for polyethylene-polypropylene. Solvents with solubility parameters in the approximate range of 6.9 to 9.4 will generally dissolve the rubber phase of the thermoplastic rubber polymers used in the practice of the present invention.

The solubility parameter for polystyrene is about 9.1. Solvents in the approximate range of 7.7 to 10.1 will generally dissolve the polystyrene phase of the thermoplastic rubber polymers utilized in the practice of the present invention. Solvents in a central overlapping range between 7.7 and 9.4 will usually dissolve both rubber and styrene phases and give low viscosity solutions. Single solvents usually fall in this range. Solvent blends may fall outside this range if the blend contains both a solvent good for the rubber phase and a solvent good for the polystyrene phase.

Solvents at the lower end of the solubility parameter scale (below 7.7) will dissolve the rubber phase only and produce solutions which increase rapidly in viscosity as the solubility parameter decreases. The ultimate result is a gel. An example of a solvent of this type is hexane ($\delta=7.3$). This gelation occurs because the rubber is still solvated but the polystyrene is not. It has precipitated, resulting in a crosslink network of swollen rubber, i.e. a gel.

Solvents at the upper end of the solubility parameter scale (from about 9.4 to 10.1) are good for the styrene only and the elastomeric blocks become less and less soluble as the solubility parameter progresses. Use of these solvents can give opalescent solutions, drifting viscosity with aging and non-Newtonian viscosity behavior. This is because the polystyrene is still solvated, but the rubber has begun to precipitate. This gives a suspension of precipitated rubber particles surrounded by the polystyrene endblocks which are still in solution.

The solubility parameter range of 7.7 to 9.4 is still only a general guide, however, and cannot be taken as absolute. However, the selection of specific solvents which are capable of dissolving specific polymers of the type employed herein is deemed to be within the scope of those skilled in the art and, in view of the multiple factors involved, it may often be desirable to test each solvent or blend of solvents for its effect on the thermoplastic rubber polymers used in the practice of the present invention. Toluene and a blend of hexane/methyl ethyl ketone and dichloromethane have been found to be particularly useful solvents for dissolving the thermoplastic rubber polymers utilized herein. The only essential criteria for the solvent that is selected is that the specific solvent used to form the polymer solution be capable of dissolving both the polystyrene domains and the rubber network present in the thermoplastic rubber polymers used in the practice of the present invention at ambient temperature and that the solvent chosen will permit the polymer to precipitate out of the solution onto the surfaces of the toner particles when the polymer solution is mixed with the pigment dispersion.

The following Table I comprises a list of many of the solvents along with their solubility parameters which may be used to dissolve the thermoplastic rubber polymers utilized in the present invention.

| Solubility Parameters of Solvents by Chemical Types | Sol. Par.[1] |
|---|---|
| Aromatic Hydrocarbons | |
| Styrene | 8.7 |
| Ethylbenzene | 8.8 |
| Xylene | 8.8 |
| Toluene | 8.9 |
| Benzene | 9.2 |
| Hydrocarbons | |
| Methylcyclohexane | 7.8 |
| Turpentine | 8.1 |
| Cyclohexane | 8.2 |
| Chlorinated Hydrocarbons | |
| 2,2-dichloropropane | 8.2 |
| Carbon tetrachloride | 8.6 |
| 1,2-dichloropropane | 9.0 |
| Chloroform | 9.3 |
| Trichlorethylene | 9.3 |
| Tetrachlorethylene | 9.4 |
| Ketones | |
| Diisobutyl | 7.8 |
| Diisopropyl | 8.0 |
| Methyl isobutyl | 8.4 |
| Methyl amyl | 8.5 |
| Methyl propyl | 8.7 |
| Diethyl | 8.9 |
| Isophorone | 9.1 |
| Diacetone alcohol | 9.2 |
| Methyl cyclohexanone | 9.3 |
| Methyl ethyl | 9.3 |
| Esters | |
| Isobutyl-n-butyrate | 7.8 |
| Isopropyl isobutyrate | 7.9 |
| Methyl amyl acetate | 8.0 |
| Butyl butyrate | 8.1 |
| Sec. butyl acetate | 8.1 |
| Sec. amyl acetate | 8.3 |
| Isobutyl acetate | 8.3 |
| Isopropyl acetate | 8.4 |
| Amyl acetate | 8.5 |
| Butyl acetate | 8.5 |
| Cellosolve acetate[2] | 8.7 |
| Propyl acetate | 8.8 |
| Ethyl acetate | 9.1 |
| Propyl formate | 9.2 |
| Dibutyl phthalate | 9.4 |
| Ethers | |
| Dimethyl | 8.8 |
| Alcohols | |
| Butyl Carbitol | 8.9 |
| Butyl Cellosolve | 9.1 |
| Diethylene glycol | 9.1 |

[1] $(cal/cm^3)^{\frac{1}{2}}$
[2] Union Carbide Corp., Trademark

The solvent used for forming the pigment dispersion and the organic phase may be selected from among any of the well known solvents capable of forming a dispersion with the particular pigment selected for use in practicing the present invention, dissolving the polymers of the type employed herein to form the toner binder and are immiscible with water. Additionally, the solvent selected must also comprise a solvent in which the elastomeric thermoplastic polymers utilized in the practice of the present invention are insoluble at ambient temperature. The selection of such specific solvents is deemed to be within the scope of those skilled in the art and, as mentioned previously, the solvents used to form the pigment dispersion and the organic phase may be the same or different as long as they meet the foregoing criteria. For example, ethyl acetate is a particularly useful solvent for forming a pigment dispersion when quinacridone magenta, Novaperm Yellow and bridged aluminum phthalocyanine cyan are used as pigments in forming the pigment dispersion used herein and linear styrene-ethylene-butylene-styrene copolymer and dichloromethane are used in forming the polymer solution used herein. In general, the solvent used to form the pigment dispersion also comprises the solvent component of the organic phase. It should readily be apparent to one skilled in the art that the solvent chosen to dissolve the elastomeric thermoplastic polymer at ambient temperature must also be immiscible with water. In carrying-out the process of the present invention, the solvent which is used to prepare the polymer solution is immiscible with both the solvents used to form the pigment dispersion and the solvent used to prepare the organic phase and will merely become additive to the organic phase upon introducing the polymer coated pigment dispersion into the organic phase.

The particulate stabilizer selected for use herein may be selected from among highly cross-linked polymeric latex materials of the type described in U.S. Pat. No. 4,965,131 issued on Oct. 23, 1990 to M. Nair et al. or silicon dioxide. Each of these stabilizers has colloidal dimensions and is well suited for use in the practice of the present invention. The particulate stabilizer is generally used in an amount ranging from 1 to 15 parts based on 100 parts of the total solids employed.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. It will be appreciated by those skilled in the art that the promoter is required only when silica is employed as the stabilizing agent. When latex is employed for this purpose, the hydrophobic/hydrophilic characteristics are provided by the choice of co-monomers used. Typical of such promoters are sulfonated polystyrenes, alginates, carboxy methyl cellulose, tetramethyl ammonium hydroxide or chloride, diethylaminoethylmeythacrylate, water soluble complex resinous amine condensation products such as the water soluble condensation products of diethanol amine and adipic acid, water soluble condensation products of ethylene oxide, urea and formaldehyde and polyethyleneimine. Also effective for this purpose are gelatin, glue, casein, albumin, gluten and the like or nonionic materials such as methoxycellulose. The promoter is generally used in an amount ranging from about 0.2 to 0.6 parts per 100 parts of aqueous solution.

Various additives generally present in electrostatographic toner may be added to the polymer prior to dissolution in the solvent or in the dissolution step itself, such as charge-control agents. Suitable charge-control agents are disclosed, for example, in U.S. Pat. Nos.3,893,935; 4,079,014; 4,323,634 and British Patent Nos. 1,501,085 and 1,420,839. Charge-control agents are generally employed in small quantities such as from about 0 to about 10 parts per hundred based upon the weight of the total solids content (weight of the toner) and preferably from about 0.2 to about 3.0 parts per hundred.

The resultant mixture is then subjected to mixing and homogenization. In this process, the particulate stabilizer forms an interface between the organic globules in the organic phase. Due to the high surface area associated with small particles, the coverage by the particulate stabilizer is not complete. Coalescence continues until the surface is completely covered by particulate stabilizer. Thereafter, no further growth of the particles occurs. Accordingly, the amount of the particulate stabilizer is inversely proportional to the size of the toner obtained. The relationship between the aqueous phase and the organic phase, by volume, may range from 1.5:1 to approximately 9:1. This indicates that the organic phase is typically present in an amount from about 10% to 40% of the total homogenized volume.

Following the homogenization treatment, the solvent present is evaporated and the resultant product washed and dried.

As indicated above, the present invention is applicable to the preparation of polymeric toner particles from any type of polymer that is capable of being dissolved in a solvent that is immiscible with water and includes compositions such as, for example, olefin homopolymers and copolymers, such as polyethylene, polypropylene, polyisobutylene and polyisopentylene; polyfluoroolefins, such as polytetrafluorethylene and polytrifluorochloroethylene; polyamides, such as polyhexamethylene adipamide, polyhexamethylene sebacamide, and polycaprolactum; acrylic resins, such as polymethylmethacrylate, polymethylacrylate, polyethylmethacrylate and styrene-methylmethacrylate; ethylene-methyl acrylate copolymers, ethylene-ethyl acrylate copolymers, ethylene-ethyl methacrylate copolymers, polystyrene and copolymers of styrene thereof with unsaturated monomers, cellulose derivatives, polyester, polyvinyl resins and ethylene-allyl alcohol copolymers and the like. The first and second polymers described herein may be the same or different and may include any of the foregoing materials.

Pigments suitable for use in the practice of the present invention should be capable of being media milled, or otherwise commingled and dispersed and thus be dispersible in the solvent and be insoluble in the aqueous phase and yield strong, permanent color. Typical of such pigments are the organic pigments such as phthalocyanines, lithols and the like and inorganic pigments such as $TiO_2$, carbon black and the like. Typical of the phthalocyanine pigments are copper phthalocyanine, mono-chlor copper phthalocyanine, and hexadecachlor copper phthalocyanine. Other organic pigments suitable for use herein include anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthrimide brown CL1151, dibenzanthrone green CL1101, flavanthrone yellow CL1118; azo pigments such as toluidine red C169 and hansa yellow; and metallized pigments such as azo yellow and permanent red. The carbon black may be of any of the known types such as channel black, furnace black, acetylene black, thermal black, lamp black and aniline black. The pigments are employed in an amount sufficient to give a content thereof in the toner from about 1 to 40%, by weight, based upon the weight of the toner, and preferably within the range of 4 to 20%, by weight.

Alternatively and, if desired, the polymer coated pigment particles formed as a result of admixing the polymer solution and the pigment dispersion can be recovered from the dispersion and then mixed with a solvent in which the polymer is insoluble at ambient temperature and, optionally, a second polymer material and, optionally, a charge-control agent to form an organic phase which can then be dispersed in an aqueous phase as described previously herein to form an electrostatographic toner composition of the present invention containing polymer-encapsulated pigment particles.

Further, and if desired, the elastomeric thermoplastic polymer solution prepared as described herein can be added at ambient temperature directly to an organic phase formed from a pigment, a polymeric material as described herein and a solvent in which the elastomeric thermoplastic polymer is insoluble at ambient temperature and, optionally, a charge-control agent whereupon the elastomeric thermoplastic polymer precipitates out upon the surface of the pigment upon introduction of the polymer solution into the organic phase and the organic phase subsequently dispersed in an aqueous phase as described herein to form the polymer encapsulated pigment containing toner particles of the present invention.

Still further, and if desired, a pigment dispersion can be formed by mixing, as for example, by media milling a pigment, a first polymer material, and an elastomeric thermoplastic polymer of the type described herein in a solvent in which the elastomeric thermoplastic polymer is soluble at ambient temperature and then mixing at ambient temperature the pigment dispersion thus formed with a solvent in which the elastomeric thermoplastic polymer is insoluble at ambient temperature and, optionally, a second polymer material, and optionally, a charge-control agent to form an organic phase so resulting in the elastomeric thermoplastic polymer precipitating out upon the surface of the pigment upon the introduction of the pigment dispersion into the organic phase and the organic phase subsequently dispersed in an aqueous phase as described herein to form the polymer encapsulated pigment containing toner particles of the present invention.

The invention will be more fully understood by reference to the following exemplary embodiment which is set forth solely for the purpose of exposition and is not to be construed as limiting.

EXAMPLE 1

A solution of a styrene-ethylene-butylene-styrene block copolymer was prepared in dichloromethane at room temperature by mixing 3.6 grams of a linear styrene-ethylene-butylene-styrene copolymer (styrene/-rubber ratio=29/71) obtained commercially from Shell Chemical Company, Houston, Tex. designated as Kraton G1652 to 142.0 grams of dichloromethane. This solution was slowly added to 62.5 grams of a media milled dispersion of quinacridone magenta pigment at room temperature. This magenta pigment dispersion was prepared from a mixture of 76.9 grams of quinacridone magenta pigment, 15.49 grams of commercially available surfactant (Solsperse 24,000) and 7.7 grams of styrene-butyl acrylate copolymer (Piccotoner 1221 manufactured by Hercules-Sanyo, Inc., Wilmington, Del.) in 769.2 grams of ethyl acetate (13 percent solids of mixture). Since Kraton G1652 is insoluble in ethyl acetate, addition of its solution prepared in dichloromethane results in its precipitation on the surface of the pigment dispersed in ethyl acetate. This step essentially permits the surface treatment of the dispersed pigment at room temperature by taking advantage of the differential solubility in different solvents. The concentration of Kraton G1652 was maintained at a pigment to Kraton G1652 ratio of 1.74:1. Once all of the Kraton G1652 solution had been added to the pigment dispersion solution, to this resulting treated pigment solution was added 34.6 grams of styrene-butyl acrylate copolymer (Piccotoner 1221 manufactured by Hercules-Sanyo Inc., Wilmington, Del.), 7.3 grams of dichloromethane and 0.5 gram of tetradecyl pyridinium tetraphenylborate as charge controlling agent. This resulted in a total organic phase of 257.25 grams. Next, the mixture was added to an aqueous phase comprising 750 milliliters of a buffer having a pH of 10 and 40 milliliters of latex particles (3% solid content) of the type described in U.S. Pat. No. 4,965,131. Then, the mixture was subjected to sheer using a Polytron sold by Brinkman followed by a Microfluidizer. Upon exiting, the solvent was removed from the particles so formed by stirring overnight at 25° C. in an open container. The particles formed were found to have a particle size ranging from about 2 to 5 micrometers in size. These particles were then washed with water and dried. The particles evidenced a size distribution ranging from 3 to 4 micrometers and are useful as electrostatographic toner.

EXAMPLE 2

A solution of a styrene-ethylene-butylene-styrene block copolymer was prepared in dichloromethane at room temperature by mixing 2.5 grams of a linear styrene-ethylene-butylene-styrene copolymer (styrene/-rubber ratio=29/71) obtained commercially from Shell Chemical Company, Houston, Tex. designated as Kraton G1652 to 97.5 grams of dichloromethane. This solution was slowly added to 100.0 grams of a media milled dispersion of quinacridone magenta pigment at room temperature. This magenta pigment dispersion was prepared from a mixture of 76.9 grams of quinacridone magenta pigment, 15.49 grams of commercially available surfactant (Solsperse 24,000) and 7.7 grams of styrene-butyl acrylate copolymer (Piccotoner 1221 manufactured by Hercules-Sanyo, Inc., Wilmington, Del.) in 769.2 grams of ethyl acetate (13 percent solids of mixture). The resulting mixed solution was stirred for 2 hours in a covered container using a magnetic stirrer. Following this, the ethyl acetate and dichloromethane were evaporated over a period of 2 days in an open crystallizing dish at ambient conditions. The dried milled pigment which is surface treated with Kraton G1652, consisted of 64.5% pigment, 12.0% Solsperse 24,000, 6.45% Piccotoner 1221 and 16.1% Kraton G1652. Next, 9.7 grams of this surface treated pigment was added to 200.0 grams of ethyl acetate along with 40.3 grams of linear styrene-butyl acrylate copolymer (Piccotoner 1221 manufactured by Hercules-Sanyo Inc., Wilmington, Del.), and 0.5 gram of tetradecyl pyridinium tetraphenylborate as charge controlling agent. Since Kraton G1652 is insoluble in ethyl acetate, addition of the surface treated pigment to this solvent does not result in the removal of Kraton G1652 from the pigment surface and therefore pigment surface treatment is maintained. This step essentially permits the surface treatment of the dispersed pigment at room temperature by taking advantage of the differential solubility in different solvents. The concentration of Kraton G1652 was maintained at a pigment to Kraton G1652 ratio of 4:1. Next, the mixture was added to an aqueous phase comprising 750 milliliters of a buffer having a pH of 10 and 50 milliliters of latex particles (3% solid content) of the type described in U.S. Pat. No. 4,965,131. Then, the mixture was subjected to sheer using a Polytron sold by Brinkman followed by a Microfluidizer. Upon exiting, the solvent was removed from the particles so formed by stirring overnight at 25° C. in an open container. The particles formed were found to have a particle size ranging from about 2 to 5 micrometers in size. These particles were then washed with water and dried. The particles evidenced a size distribution ranging from 3 to 4 micrometers and are useful as electrostatographic toner.

EXAMPLE 3

A magenta pigment dispersion was prepared by media milling 20.0 grams of quinacridone magenta pigment and 10.0 grams of a linear styrene-ethylene-butylene-styrene copolymer (styrene/rubber ratio=29/71) obtained commercially from Shell Chemical Company, Houston, Tex. designated as Kraton G1652 in 200.0 grams of dichloromethane. This resulted in a 13 percent solids in solution. Next 70.0 grams of this milled magenta dispersion was added to 99.1 grams of ethyl acetate along with 30.9 grams of a linear styrene-butyl acrylate copolymer (Piccotoner 1221 manufactured by Hercules-Sanyo, Inc., Wilmington, Del.) and 0.5 gram of tetradecyl pyridinium tetraphenylborate as charge controlling agent at room temperature and stirred for one hour. Since Kraton G1652 is insoluble in ethyl acetate and soluble in dichloromethane, addition of the milled pigment dispersion prepared in dichloromethane to ethyl acetate results in the precipitation Kraton G1652 on the surface of the milled pigment. Therefore, this procedure permits the surface treatment of a dispersed pigment at room temperature by taking advantage of the differential solubility in different solvent. The concentration of Kraton G1652 was maintained at a pigment to Kraton G1652 ratio of 2:1. Next, the mixture was added to an aqueous phase comprising 750 milliliters of a buffer having a pH of 10 and 43.2 milliliters of latex particles (3% solid content) of the type described in U.S. Pat. No. 4,965,131. Then, the mixture was subjected to sheer using a Polytron sold by Brinkman followed by a Microfluidizer. Upon exiting, the solvent was removed from the particles so formed by stirring overnight at 25° C. in an open container. The particles formed were found to have a particle size ranging from about 2 to 5 micrometers in size. These particles were then washed with water and dried. The particles evidenced a size distribution ranging from 3 to 4 micrometers and are useful as electrostatographic toner.

EXAMPLE 4

A yellow pigment dispersion was prepared by media milling 15.0 grams of Novaperm Yellow pigment and 75.0 grams of a linear styrene-ethylene-butylene-styrene copolymer (styrene/rubber ratio=29/71) obtained commercially from Shell Chemical Company, Houston, Tex. designated as Kraton G1652 in 200.0 grams of dichloromethane. Next 25.0 grams of this media milled yellow pigment dispersion was added to 387.5 grams of ethyl acetate along with 127.5 grams of a linear styrene-butyl acrylate copolymer (Piccotoner 1221 manufactured by Hercules-Sanyo, Inc., Wilmington, Del.) and 0.6 gram of tetradecyl pyridinium tetraphenylborate as charge-controlling agent at room temperature and stirred for one hour. Since Kraton G1652 is insoluble in ethyl acetate and soluble in dichloromethane, addition of the media milled pigment dispersion prepared in dichloromethane to ethyl acetate results in the precipitation Kraton G1652 on the surface of the milled pigment. Therefore, this procedure permits the surface treatment of a dispersed pigment at room temperature by taking advantage of the differential solubility in different solvents. The concentration of Kraton G1652 was maintained at a pigment to Kraton G1652 ratio of 2:1. Next, the mixture was added to an aqueous phase comprising 2250 milliliters of a buffer having a pH of 10 and 158 milliliters of latex particles (3% solid content) of the type described in U.S. Pat. No. 4,965,131. Then, the mixture was subjected to sheer using a Polytron sold by Brinkman followed by a Microfluidizer. Upon exiting, the solvent was removed from the particles so formed by stirring overnight at 25° C. in an open container. The particles formed were found to have a particle size ranging from about 2 to 5 micrometers in size. These particles were then washed with water and dried. The particles evidenced a size distribution ranging from 3 to 4 micrometers and are useful as electrostatographic toner.

EXAMPLE 5

A cyan pigment dispersion was prepared by media milling 13.5 grams of bridged aluminum phthalocyanine pigment and 6.75 grams of a linear styrene-ethylene-butylene-styrene copolymer (styrene/rubber ratio=29/71 obtained commercially from Shell Chemical Company, Houston Tex. designated as Kraton G1652 in 200.0 grams of dichloromethane. Next, 225 grams of this media milled cyan pigment dispersion was added to 408.75 grams of ethyl acetate along with 116.25 grams of a linear styrene-butyl acrylate copolymer (Piccotoner 1221 manufactured by Hercules-Sanyo, Inc., Wilmington, Del.) and 0.6 gram of tetradecyl pyridinium tetraphenylborate as charge-controlling agent at room temperature and stirred for one hour. Since Kraton G1652 is insoluble in ethyl acetate and soluble in dichloromethane, addition of the media milled pigment dispersion prepared in dichloromethane to ethyl acetate results in the precipitation Kraton G1652 on the surface of the milled pigment. Therefore, this procedure permits the surface treatment of a dispersed pigment at room temperature by taking advantage of the differential solubility in different solvents. The concentration of Kraton G1652 was maintained at a pigment to Kraton G1652 ratio of 2:1. Next, the mixture was added to an aqueous phase comprising 2250 milliliters of a buffer having a pH of 10 and 158 milliliters of latex particles (3% solid content) of the type described in U.S. Pat. No. 4,965,131. Then, the mixture was subjected to sheer using a Polytron sold by Brinkman followed by a Microfluidizer. Upon exiting, the solvent was removed from the particles so formed by stirring overnight at 25° C. in an open container. The particles formed were found to have a particle size ranging from about 2 to 5 micrometers in size. These particles were then washed with water and dried. The particles evidenced a size distribution ranging from 3 to 4 micrometers and are useful as electrostatographic toner.

EXAMPLE 6

A magenta pigment dispersion was prepared by media milling 20.0 grams of quinacridone magenta pigment and 10.0 grams of a linear styrene-isoprene-styrene copolymer (styrene/rubber ratio=30/70) obtained commercially from Shell Chemical Company, Houston, Tex. designated as Kraton D1112 in 200.0 grams of dichloromethane. This resulted in 13 percent solids in solution. Next 70.0 grams of this media milled magenta pigment dispersion was added to 99.1 grams of ethyl acetate along with 30.9 grams of a linear styrene-butyl acrylate copolymer (Piccotoner 1221 manufactured by Hercules-Sanyo, Inc., Wilmington, Del.) and 0.5 gram of tetradecyl pyridinium tetraphenylborate as charge-controlling agent at room temperature and stirred for one hour. Since Kraton D1112 is insoluble in ethyl acetate and soluble in dichloromethane, addition of the media milled pigment dispersion prepared in dichloromethane to ethyl acetate results in the precipitation Kraton D1112 on the surface of the milled pigment. Therefore, this procedure permits the surface treatment of a dispersed pigment at room temperature by taking advantage of the differential solubility in different solvents. The concentration of Kraton D1112 was maintained at a pigment to Kraton D1112 ratio of 2:1. Next, the mixture was added to an aqueous phase comprising 750 milliliters of a buffer having a pH of 10 and 43.2 milliliters of latex particles (3% solid content) of the type described in U.S. Pat. No. 4,965,131. Then, the mixture was subjected to shear using a Polytron sold by Brinkman followed by a microfluidizer. Upon exiting, the solvent was removed from the particles so formed by stirring overnight at 25° C. in an open container. The particles formed were found to have a particle size ranging from about 2 to 5 micrometers in size. These particles were then washed with water and dried. the particles evidenced a size distribution ranging from 3 to 4 micrometers and are useful as electrostatographic toner.

In order to compare toners prepared in the foregoing manner with those of the prior art in which the pigment particles were not coated with an elastomeric thermoplastic polymer of the present invention, surface morphologies were studied for different preparative techniques. Thus, for example, a quinacridone magenta latex limited coalescence toner prepared in accordance with conventional prior art limited coalescence in which the pigment particles were not coated with an elastomeric thermoplastic polymer of the present invention evidenced an irregular surface due to the accumulation of magenta pigment at the surface of the toner during the coalescence process. Generally, the use of a more hydrophobic magenta pigment such as hydrophobic Fanal Pink (a rhodamine) has been found to result in the formation of pigment having more of a spherical shape. Micrographs obtained by studying the quinacridone containing latex toner particles prepared as described herein revealed that the spherical nature of the toner is greatly enhanced as the amount of the elastomeric thermoplastic polymer is increased. Accordingly, thermoplastic polymer encapsulation of the surface of the pigment with the elastomeric thermoplastic polymers of the type utilized herein and in the manner described herein is shown to be highly beneficial. Furthermore, since it is known that surface active pigments in limited coalescence toners evidence low charge and poor charge stability, any effort to avoid their proximity to the surface of the toner will result in an enhancement of the triboelectric performance. This assertion is vindicated by reference to Table II set forth below which contrasts the charging behavior of toner prepared with thermoplastic polymer encapsulation (as described herein) and without such encapsulation.

TABLE II

| Sample | Pigment | Thermoplastic Polymer coating | Q/M (Microcoloumbs/g) Fresh | Exercised |
|---|---|---|---|---|
| Control | 15% Quinacridone Magenta | None | 170 | 90 |
| Example 1 | 15% Quinacridone Magenta | 7.5% Styrene-ethylene-butylene-styrene copolymer | 189 | 175 |
| Example 2 | 15% Quinacridone Magenta | 7.5% Styrene-ethylene-butylene-styrene copolymer | 146 | 156 |
| Example 3 | 15% Quinacridone Magenta | 7.5% Styrene-ethylene butylene-styrene copolymer | 142 | 122 |
| Control | 9% Bridged Aluminum Phthalocyanine | None | 212 | 120 |
| Example 5 | 9% Bridged Aluminum Phthalocyanine | 4.5% Styrene-ethylene butylene-styrene copolymer | 151 | 130 |

As is clear from Table II, after exercising for 5 minutes by passing the toner over a magnetic brush rotating at 2000 rpm in a sealed jar, the charge per mass ratio (Q/M) of the toners prepared according to this invention declined 7.4%, from 189 to 175(μC/g) in the case of Example 1 and 14%, from 142 to 122 (μC/g) in the case of Example 3 in contrast to the control toner (no thermoplastic polymer encapsulation) which declined 47% from 170 to 90(μC/g) when quinacridone magenta pigment was used as the pigment in the toner compositions and actually increased from 146 to 156(μC/g) in the case of the toner composition of Example 2 prepared in accordance with the process of the invention. In addition, the charge per mass ratio (Q/M) of the toner of Example 5 prepared according to the process of the present invention declined only 13.9% in contrast to the control toner (no thermoplastic polymer encapsulation) which declined 43%, from 212 to 120(μC/g) when bridged aluminum phthalocyanine was used as the pigment in the preparation of the toner composition of Example 5 and the control toner.

Toner particles prepared according to this invention maintain a relatively stable charge in use whereas the comparable prior art toner particles prepared in the absence of thermoplastic polymer encapsulation according to this invention are relatively unstable in use.

While the invention has been described in detail with reference to certain preferred embodiments, it will be understood that variations may be made by those skilled in the art without departing from the spirit and scope of the invention. Thus, for example, different polymer compositions, solvents and pigments may be substituted for those employed in the examples.

What is claimed is:

1. A method for the preparation of electrostatographic toner comprising the steps of:

(a) dissolving at ambient temperature an elastomeric thermoplastic polymer selected from the group consisting linear styrene-isoprene-styrene triblock copolymers, linear styrene-ethylene-butylene-styrene triblock copolymers, linear styrene-isoprene diblock copolymers and linear styrene-ethylene-propylene diblock copolymers in a first solvent capable of dissolving the polymer at ambient temperature, thereby forming a polymer solution;

(b) forming a pigment dispersion at ambient temperature by mixing a pigment, a first polymer material and a second solvent in which the elastomeric thermoplastic polymer is insoluble at ambient temperature;

(c) admixing the resultant polymer solution at ambient temperature with the pigment dispersion so resulting in the precipitation of the elastomeric thermoplastic polymer upon the surface of the pigment;

(d) mixing the polymer coated pigment dispersion thus formed at ambient temperature with a solvent in which the elastomeric thermoplastic polymer is insoluble at ambient temperature and, optionally, a second polymer material and, optionally, a charge-control agent to form an organic phase;

(e) dispersing the organic phase in an aqueous phase comprising a particulate stabilizer and, optionally, a promoter and homogenizing the resultant mixture; and (f) evaporating the solvent and washing and drying the resultant product.

2. The method of claim 1, wherein the pigment employed comprises from about 4 to 20%, by weight, of total solids including elastomeric thermoplastic polymer.

3. The method of claim 1, wherein the elastomeric thermoplastic polymer is linear styrene-ethylene-butylene-styrene block copolymer and is employed in an amount ranging from about 20 to 200%, by weight, of the pigment employed.

4. The method of claim 1, Wherein the relationship between the aqueous phase and the organic phase, by volume, ranges from about 1.5:1 to 9:1.

5. The method of claim 1, wherein the elastomeric thermoplastic polymer is linear styrene-ethylene-butylene-styrene block copolymer and the ratio of styrene to rubber is 29/71, the first solvent is dichloromethane, the second solvent is ethyl acetate and the polymer is butyl acrylate-styrene copolymer.

6. The method of claim 1, wherein the elastomeric thermoplastic polymer is linear styrene-isoprene-styrene copolymer and the ratio of styrene to rubber is 30/70, the first solvent is dichloromethane, the second solvent is ethyl acetate and the polymer is butyl acrylate-styrene copolymer.

7. The method of claim 1, wherein the particulate stabilizer is selected from the group consisting of highly crosslinked latex particles and $SiP_2$.

8. The method of claim 1, wherein the dispersion comprises media milled quinacridone magenta.

9. The method of claim 1, wherein the polymer is butyl acrylate-styrene copolymer.

10. In a method of preparing electrostatographic toner by dispersing an organic phase in an aqueous phase to yield a layer of particulate suspension stabilizer on the surface of a polymer, the improvement which comprises forming an elastomeric thermoplastic polymer coated pigment dispersion by dissolving an elastomeric thermoplastic polymer selected from the group consisting of linear styrene-isoprene-styrene triblock copolymers, linear styrene-ethylene-butylene-styrene triblock copolymers, linear styrene-isoprene diblock copolymers and linear styrene-ethylene-propylene diblock copolymers in a first solvent capable of dissolving the elastomeric thermoplastic polymer at ambient temperature thereby forming a polymer solution; forming a pigment dispersion by mixing at ambient temperature a pigment, a first polymer material and a second solvent in which the elastomeric thermoplastic polymer is insoluble at ambient temperature; admixing the polymer solution with the pigment dispersion so resulting in the elastomeric thermoplastic polymer precipitating out upon the surface of the pigment; mixing the elastomeric thermoplastic polymer coated pigment dispersion thus formed with a solvent in which the elastomeric thermoplastic polymer is insoluble at ambient temperature and, optionally, a second polymer material and, optionally, a charge-control agent to form the organic phase for dispersing in the aqueous phase.

11. The method of claim 10, wherein the elastomeric thermoplastic polymer is linear styrene-ethylene-butylene-styrene block copolymer and the ratio of styrene to rubber is 29/71, the first solvent is dichloromethane, the second solvent is ethyl acetate and the polymer is butyl acrylate-styrene copolymer.

12. The method of claim 10, wherein the elastomeric thermoplastic polymer is linear styrene-isoprene-styrene copolymer and the ratio of styrene to rubber is 30/70, the first solvent is dichloromethane, the second solvent is ethyl acetate and the polymer is butyl acrylate-styrene copolymer.

13. The method of claim 10, wherein the pigment dispersion comprises quinacridone magenta.

14. The method of claim 13, wherein the pigment to elastomeric thermoplastic polymer ratio in the pigment dispersion-polymer solution is about 2.5:1.

15. A method of preparing a uniform coating of an elastomeric thermoplastic polymer selected from the group consisting of linear styrene-isoprene-styrene triblock copolymers, linear styrene-ethylene-butylene-styrene triblock copolymers, linear styrene-isoprene diblock copolymers and linear styrene-ethylene-propylene diblock copolymers on pigment particles comprising the steps of:

(a) forming a solution of the elastomeric thermoplastic polymer in a first solvent capable of dissolving the polymer at ambient temperature;

(b) mixing the polymer solution with a pigment particle dispersion in a dispersing liquid at ambient temperature to deposit the polymer on the pigment particles as a coating on the surface of the particles; and (c) recovering the coated pigment particles.

16. A method according to claim 15 wherein the dispersing liquid is water.

17. Electrostatographic toner prepared in accordance with the method of claim 1.

18. Electrostatographic toner prepared in accordance with the method of claim 10.

* * * * *